US006720889B2

(12) United States Patent
Yamaki et al.

(10) Patent No.: US 6,720,889 B2
(45) Date of Patent: Apr. 13, 2004

(54) TRAFFIC VIOLATION WARNING AND TRAFFIC VIOLATION STORAGE APPARATUS

(75) Inventors: Tomokazu Yamaki, Yokohama (JP); Tsutomu Nishizaka, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/862,155

(22) Filed: May 21, 2001

(65) Prior Publication Data

US 2002/0036572 A1 Mar. 28, 2002

(30) Foreign Application Priority Data

May 22, 2000 (JP) ..... 2000-150493

(51) Int. Cl.[7] ..... G08G 1/01

(52) U.S. Cl. ..... 340/933; 340/439; 340/905; 340/936; 340/995; 701/117; 701/119

(58) Field of Search ..... 340/933, 935, 340/936, 905, 995, 438, 441, 539, 990, 439; 701/119, 200, 207, 213, 117

(56) References Cited

U.S. PATENT DOCUMENTS 5,515,042 A * 5/1996 Nelson ..... 340/937
5,794,164 A * 8/1998 Beckert et al. ..... 701/1
5,952,941 A * 9/1999 Mardirossian ..... 340/936
6,222,463 B1 * 4/2001 Rai ..... 340/928
6,516,273 B1 * 2/2003 Pierowicz et al. ..... 701/301

FOREIGN PATENT DOCUMENTS

JP 5-11700 1/1993

* cited by examiner

*Primary Examiner*—Davetta W. Goins
(74) *Attorney, Agent, or Firm*—Pearne & Gordon LLP

(57) ABSTRACT

A vehicle location detector detects the vehicle state such as the location and speed from a GPS signal. Memory stores map data and traffic regulation data in advance. It is determined whether there is the possibility that a driver commits traffic violations based on the vehicle state information and traffic regulation data on the road where the vehicle is traveling. In case it is determined that there is the possibility that the driver commits traffic violations, a traffic violation warning is output via voice and displayed on a display. It is also determined whether the driver has committed traffic violations based on the vehicle state information and traffic regulation data. In case it is determined that the driver has committed traffic violations, the traffic violation details are recorded in traffic violation memory.

9 Claims, 12 Drawing Sheets

GPS SATELLITE
81
TRAFFIC LIGHT CONTROLLER
83
TRAFFIC LIGHT STATE TRANSMITTER
82
TRAFFIC LIGHT STATE RECEIVER
61
VEHICLE LOCATION DETECTOR
10
MEMORY
20
CONTROLLER
40
INPUT SECTION
73
DISPLAY
72
100
TRAFFIC VIOLATION MEMORY
51
TRAFFIC VIOLATION MEMORY DRIVER SECTION
52
AUDIO OUTPUT SECTION
71

TRAFFIC VIOLATION WARNING AND TRAFFIC VIOLATION STORAGE APPARATUS

BACKGROUND OF THE INVENTION

The present invention relates to traffic violation warning and traffic violation storage apparatus and in particular to traffic violation warning and traffic violation storage apparatus that predicts and warns against traffic violations, stores traffic violation details and updates traffic regulation data and penal regulation data.

Conventional apparatus that warns against traffic violations is a vehicle-mounted car navigation system disclosed in the Japanese Patent Publication No. H05-011700. FIG. 13 shows the configuration of the vehicle-mounted car navigation system. The vehicle-mounted car navigation system 300 detects the location of a vehicle by receiving a radio wave emitted from a location beacon by an antenna 317 and radio apparatus 316. The system also detects the direction of travel of a vehicle via a sensor 310. The system reads road traffic regulation information corresponding to the information on the location of the vehicle from a CD-ROM 311 via a CD-ROM driver 312 then displays the road traffic regulation information on a display 313. The traffic violation determination section 320 compares the information on the location of the vehicle with the road traffic regulation information and determines whether the driver commits traffic violations. In case the driver commits traffic violations, the system issues a warning via the display 313, a warning lamp 321 and/or a speaker 322.

However, since the conventional vehicle-mounted car navigation system issues a warning once the driver of the vehicle has committed traffic violations, it is not possible to prematurely prevent traffic violations. Another problem is that the system is not capable of determine traffic violations concerning ignorance of the traffic lights. The system cannot determine traffic violations corresponding to the temporary modifications to traffic regulations due to weather or permanent modifications to traffic regulations.

The police control traffic violations on a daily basis because traffic violations cause traffic jams and/or accidents. The control, however, is not perfect because the number of policemen is limited.

SUMMARY OF THE INVENTION

In order to solve the above problem, the invention provides traffic violation warning and traffic violation storage apparatus which predicts and warns against traffic violations, addressing traffic violations concerning ignorance of the traffic lights and temporary or permanent modifications to traffic regulations, and updating traffic regulation data and penal regulation data. The invention further aims at controlling traffic violators without increasing the staff.

In order the solve the problems, according to the invention, traffic violation warning and traffic violation storage apparatus comprises a vehicle location detector for detecting the location and vehicle state of a vehicle to output vehicle state information, memory for storing at least either the map data, traffic regulation data or penal regulation data, traffic violation memory for storing personal information in advance, means for determining whether there is the possibility that a driver commits traffic violations based on the vehicle state information and traffic regulation data, means for issuing a traffic violation warning in case there is the possibility that the driver commits traffic violations, means for determining whether a driver has committed traffic violations based on the vehicle state information and traffic regulation data, and means for storing traffic violation details in the traffic violation memory in case the driver has committed traffic violations.

Via this configuration, it is possible to predict and warn against traffic violations to prematurely prevent traffic violations, store traffic violation details in case traffic violations have been committed and check the details in updating the driver's license, thus assuring control with smaller group of staffs.

The traffic violation warning and traffic violation storage apparatus comprises a traffic light state receiver for receiving traffic light state information. Via this configuration, it is possible to address traffic violations concerning ignorance of the traffic lights.

The traffic violation warning and traffic violation storage apparatus comprises a traffic regulation data receiver for receiving temporarily or permanently modified traffic regulation data. Via this configuration, it is possible to determine traffic violations in accordance with temporary or permanent modifications to traffic regulations and update traffic regulation data records.

The traffic violation warning and traffic violation storage apparatus comprises a penal regulation data receiver for receiving modified penal regulation data. Via this configuration, it is possible to update penal regulation data records.

DETAILED DESCRIPTION OF THE PREFERRED EMBODIMENT

Embodiment of the present invention will be detailed referring to FIGS. 1 through 12.

(Embodiment 1)

A first embodiment of the invention is traffic violation warning and traffic violation storage apparatus for storing traffic regulation data, penal regulation data and personal information, warning a driver in case there is the possibility that he/she commits traffic violations, and storing traffic violation details in the traffic violation memory in case the driver has committed traffic violations.

Figure 1:
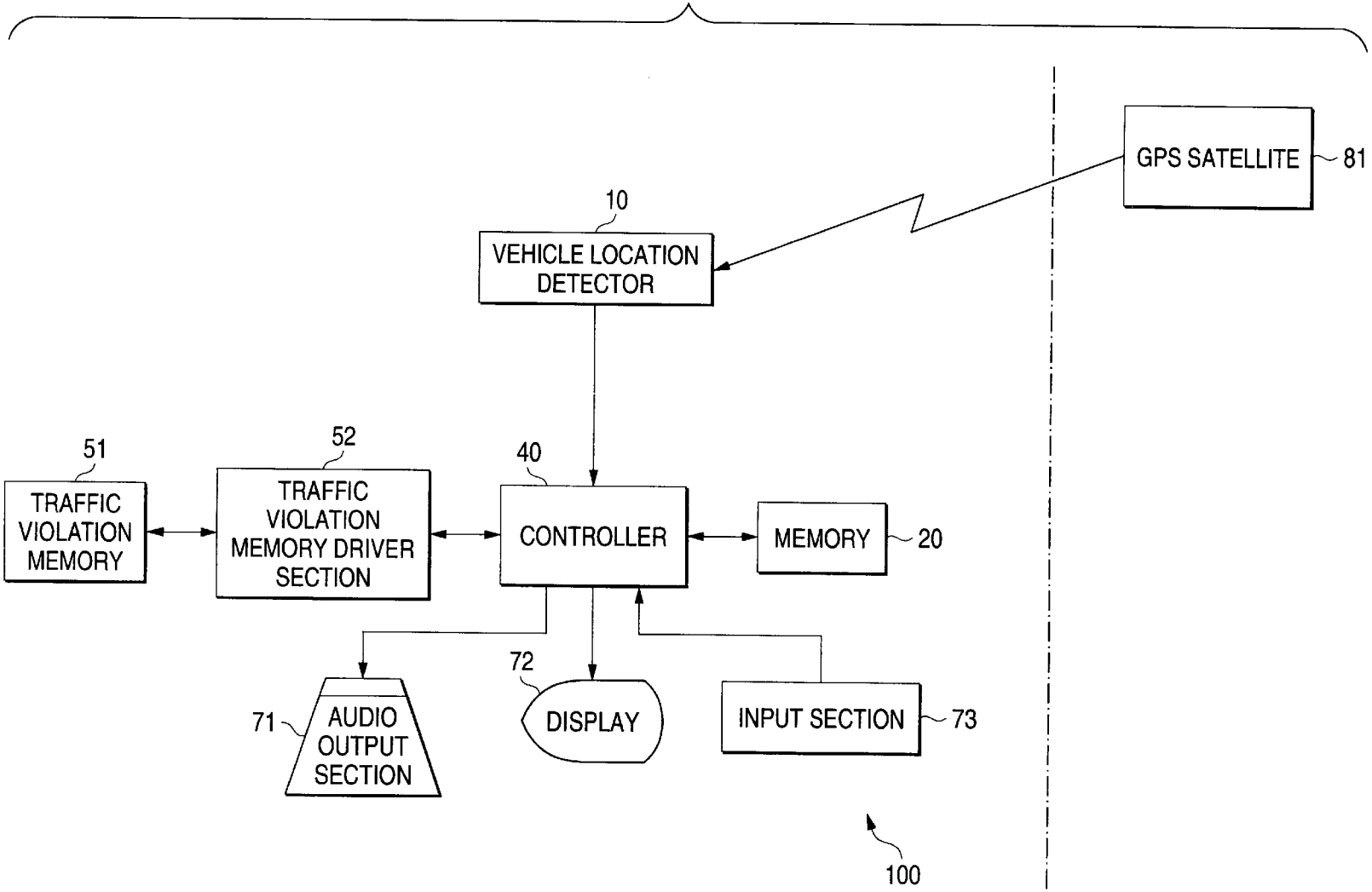
FIG. 1 is a functional block diagram of traffic violation warning and traffic violation storage apparatus according to the first embodiment of the invention.

FIG. 1 is a functional block diagram of traffic violation warning and traffic violation storage apparatus according to the first embodiment of the invention. The traffic violation warning and traffic violation storage apparatus 100 is composed of a vehicle location detector 10, memory 20, a controller 40, traffic violation memory 51, a traffic violation memory driver section 52, an audio output section 71, a display 72, and an input section 73.

In FIG. 1, the vehicle location detector 10 receives a GPS signal sent from a GPS satellite 81 to detect the vehicle state such as the location of the vehicle. The memory 20 stores map data, traffic regulation data and penal regulation data. The controller 40 controls the functional means. The traffic violation memory 51 stores personal information in advance and traffic violation details in case the driver has committed traffic violations. The traffic violation memory driver section 52 writes/reads data to/from the traffic violation memory 51. The audio output section 71 outputs map data, traffic regulation data and penal regulation data via voice. The display 72 displays map data, traffic regulation data and penal regulation data. The input section 73 accepts various settings and operations.

Figure 2:
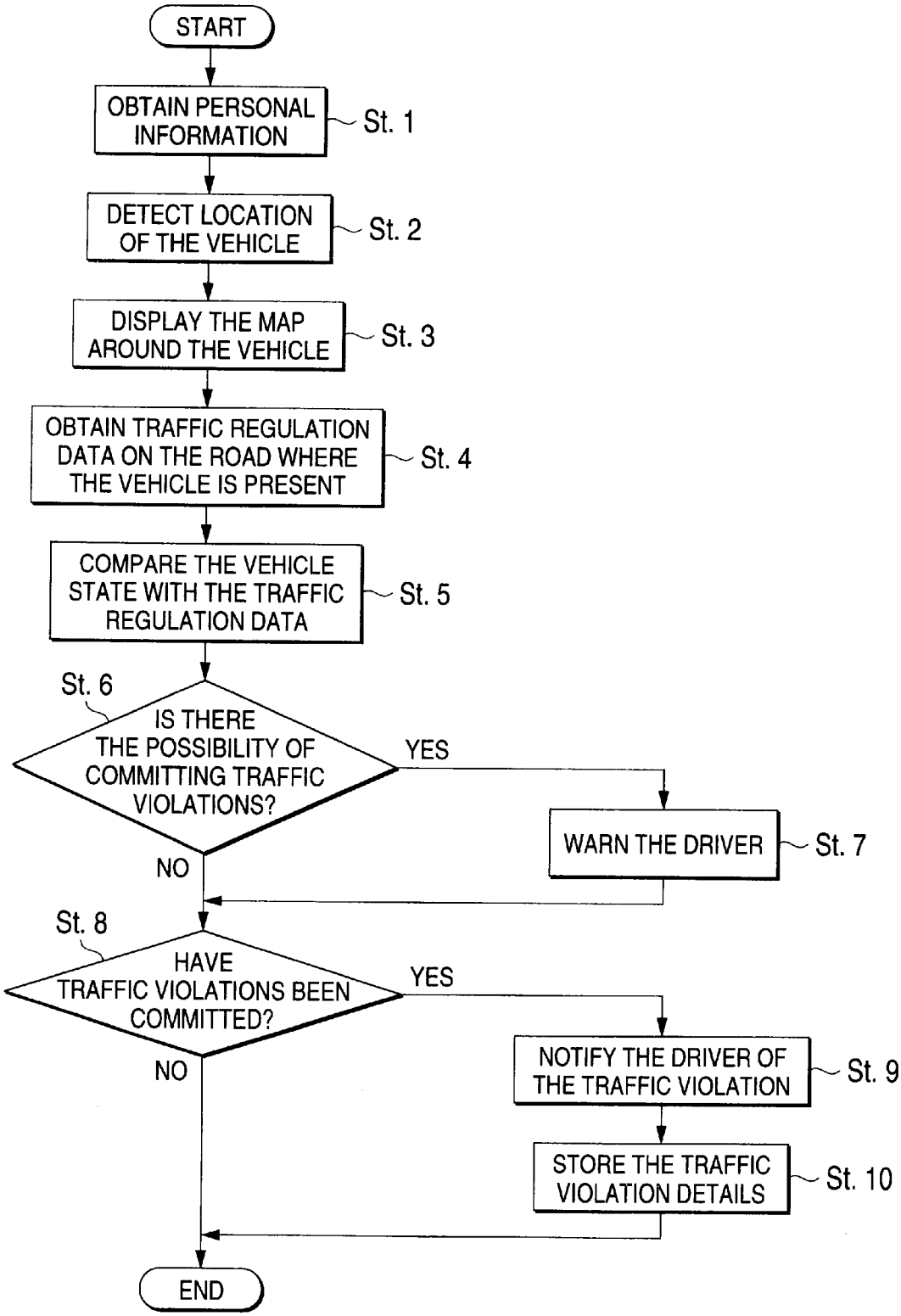
FIG. 2 is a flowchart showing the operation of the traffic violation warning and traffic violation storage apparatus according to the first embodiment of the invention.

FIG. 2 is a flowchart showing the operation of the traffic violation warning and traffic violation storage apparatus according to the first embodiment of the invention.

Operation of the traffic violation warning and traffic violation storage apparatus according to the first embodiment of the invention configured as mentioned earlier will be described referring to FIG. 1 and FIG. 2.

In Step 1 of FIG. 2 (abbreviated as St. 1 in the figure), personal information stored in advance in the traffic violation memory 51 is read by the traffic violation memory driver section 52 to recognize the driver of the vehicle. A password is used when personal information is read to check whether the personal information in the traffic violation memory 51 matches the driver of the vehicle in order to prevent illegal use of personal information in the traffic violation memory 51. Reading of personal information takes place once before the driver drives the vehicle. In case the person cannot be identified, control is made to discourage the driver from driving the vehicle. A medium with excellent portability such as an electronic card is used as the traffic violation memory 51.

In Step 2, the vehicle location detector 10 receives the GPS signal sent from the GPS satellite 81 to detect the location of the vehicle. At the same time, vehicle state information such as the time, speed and direction of travel is obtained as well as the vehicle location. The vehicle location detector 10 may be configured by a plurality of location detectior composed of a GPS receiver for receiving a GPS signal, a vehicle velocity pulse sensor and an angular velocity sensor.

In Step 3, map data on the vehicle and its vicinity is obtained from the memory 20 and displayed on the display 72.

In step 4, the road on which the vehicle is traveling based on the location of the vehicle and the traffic regulation data for the road is obtained from the memory 20.

In step 5, the vehicle state information of the vehicle obtained from the vehicle location detector 10 such as the time, speed and direction of travel, is compared with the obtained traffic regulation data such as speed limit, halt and do not enter, via the controller 40.

In step 6, based on the result of comparison of the vehicle state information and traffic regulation data, it is determined whether there is the possibility that the driver commits traffic violations. For example, in case the vehicle is traveling at a speed of 40 km/h on a road where the speed limit is 40 km/h, it is determined that there is the possibility that the driver commits traffic violations. Incase it is determined that there is the possibility of committing traffic violations, execution proceeds to Step 7. Otherwise execution proceeds to Step 8.

In Step 7, the driver of the vehicle is warned of the traffic violation determined probable based on the result of comparison of the vehicle state information and traffic regulation data via voice by way of the audio output section 71. The driver is also warned of the traffic violation via still pictures and moving pictures by way of the display 72. If necessary, the driver may be notified of the penal regulation concerning the traffic violation determined probable.

In Step 8, based on the result of comparison of the vehicle state information and traffic regulation data, it is determined whether the driver has committed traffic violations. For example, in case the driver is cruising at a speed of 41 km/h on a road where the speed limit is 40 km/h, it is determined that the driver has committed traffic violations. In case the driver has not come to a halt at a crossing where a driver must come to a halt, it is determined that the driver has committed traffic violations. In case it is determined that the driver has committed traffic violations, execution proceeds to Step 9. Otherwise the processing is terminated In step 9, the driver of the vehicle is notified of the committed traffic violation details (time, place, traffic violation name and penal regulations) via voice by way of the audio output section 71. The driver is also notified of the traffic violation via still pictures and moving pictures by way of the display 72. The personal information stored in the traffic violation memory 51 and the traffic violation details stored in Step 10 may be checked afterwards.

In step 10, the committed traffic violation details (time, place, traffic violation name and penal regulations) are stored in the traffic violation memory 51 and the processing is terminated.

Thus, according to the first embodiment of the invention, traffic violation warning and traffic violation storage apparatus stores traffic regulation data, penal regulation data and personal information, warns a driver in case there is the possibility of committing traffic violations, and stores traffic violation details in the traffic violation memory in case the driver has committed traffic violations. It is possible to predict and warn against traffic violations before a driver commits traffic violations so that traffic violations may be suppressed, notify the driver of the traffic violation details in case the driver has committed traffic violations, store the traffic violation details in the traffic violation memory, and check the data in the traffic violation memory for each driver in updating the driver's license, thereby assuring control small group of staffs.

(Embodiment 2)

A second embodiment of the invention is traffic violation warning and traffic violation storage apparatus for storing encrypted traffic violation details in case a driver has committed traffic violations.

Figure 3:
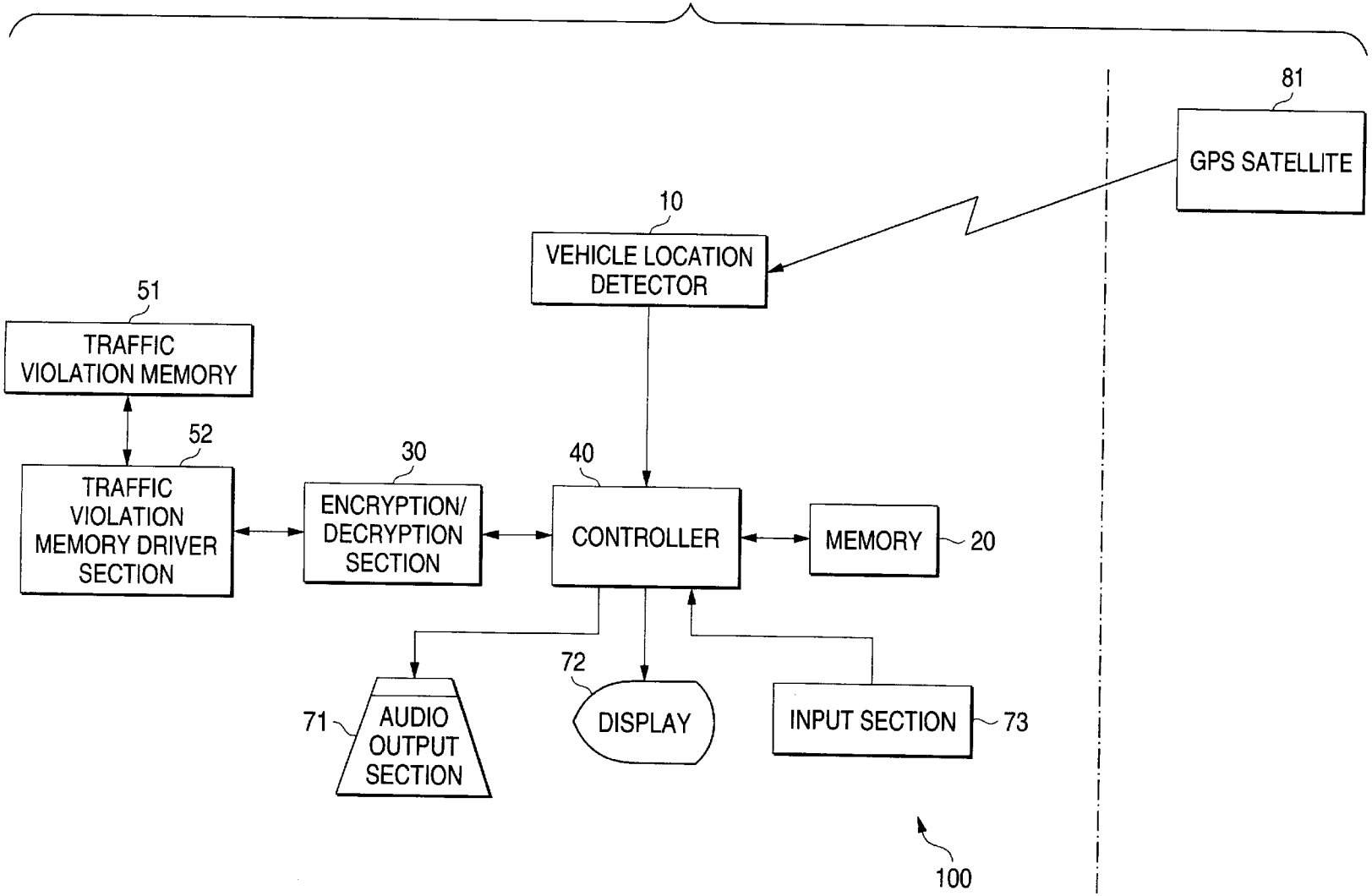
FIG. 3 is a functional block diagram of traffic violation warning and traffic violation storage apparatus according to the second embodiment of the invention.

FIG. 3 is a functional block diagram of traffic violation warning and traffic violation storage apparatus according to the second embodiment of the invention. The traffic violation warning and traffic violation storage apparatus 100 is composed of a vehicle location detector 10, memory 20, an encryption/decryption section 30, a controller 40, traffic violation memory 51, a traffic violation memory driver section 52, an audio output section 71, a display 72, and an input section 73. Basic configuration of the second embodiment is the same as the first embodiment except that an encryption/decryption section 30 is provided.

Figure 4:
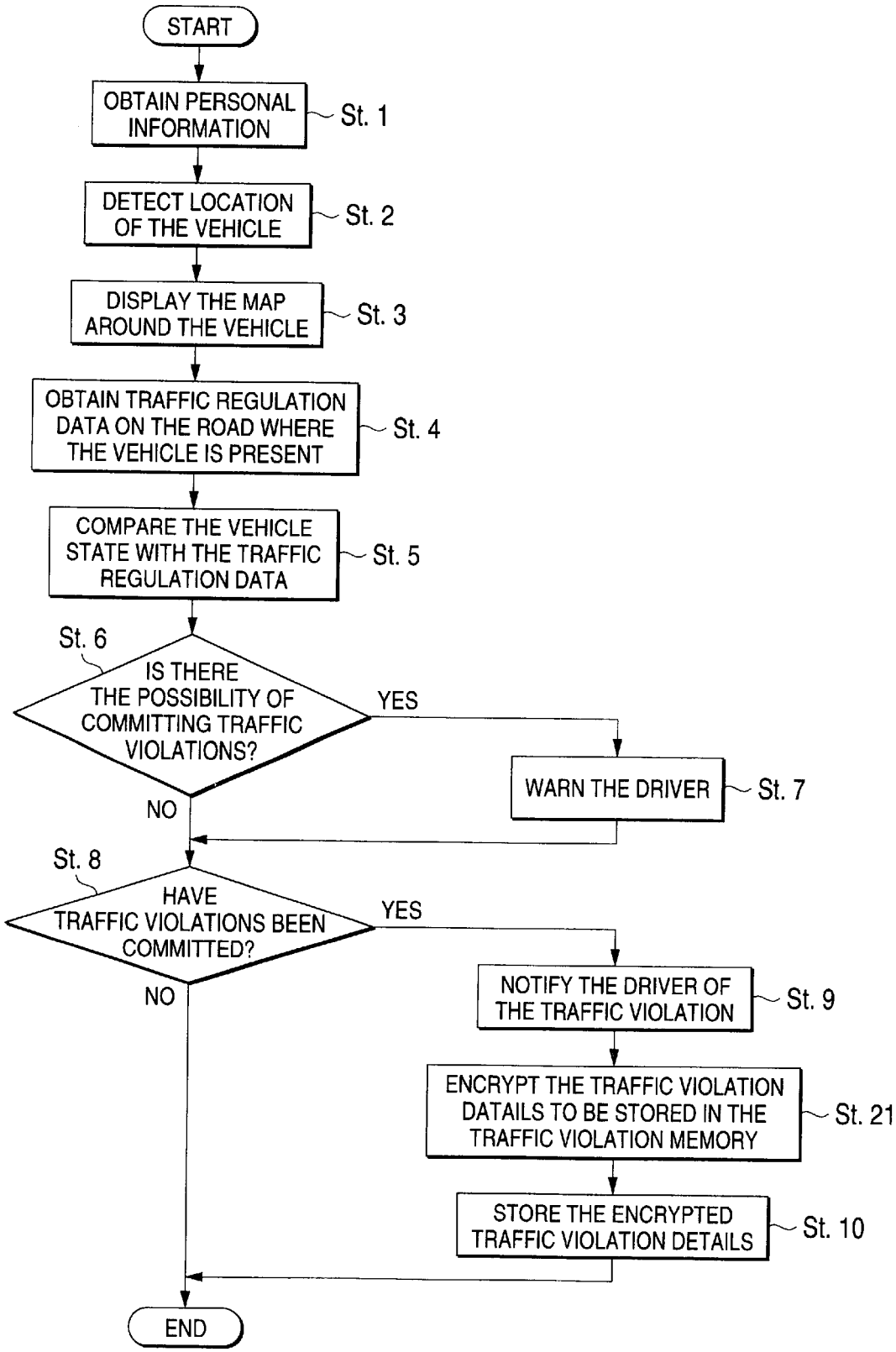
FIG. 4 is a flowchart showing the operation of the traffic violation warning and traffic violation storage apparatus according to the second embodiment of the invention.

In FIG. 3, the encryption/decryption section 30 encrypts the traffic violation details to be stored in the traffic violation memory in case a driver has committed traffic violations and decrypts the encrypted traffic violation details stored in the violation memory. FIG. 4 is a flowchart showing the operation of the traffic violation warning and traffic violation storage apparatus according to the second embodiment of the invention.

Operation of the traffic violation warning and traffic violation storage apparatus according to the second embodiment of the invention configured as mentioned earlier will be described referring to FIG. 3 and FIG. 4. Steps 1 through 9 in FIG. 4 are the same as those in the first embodiment.

In Step 21, the committed traffic violation details (time, place, traffic violation name and penal regulations) are encrypted via the encryption/decryption section 30.

In Step 10, the committed traffic violation details (time, place, traffic violation name and penal regulations) are stored in the traffic violation memory 51 and the processing is terminated.

Thus, according to the second embodiment of the invention, traffic violation warning and traffic violation storage apparatus stores encrypted traffic violation details in case a driver has committed traffic violations. This prevents falsification of traffic violation details.

(Embodiment 3)

A third embodiment of the invention is traffic violation warning and traffic violation storage apparatus for receiving traffic light state information and using the traffic light state information to determine traffic violations.

Figure 5:
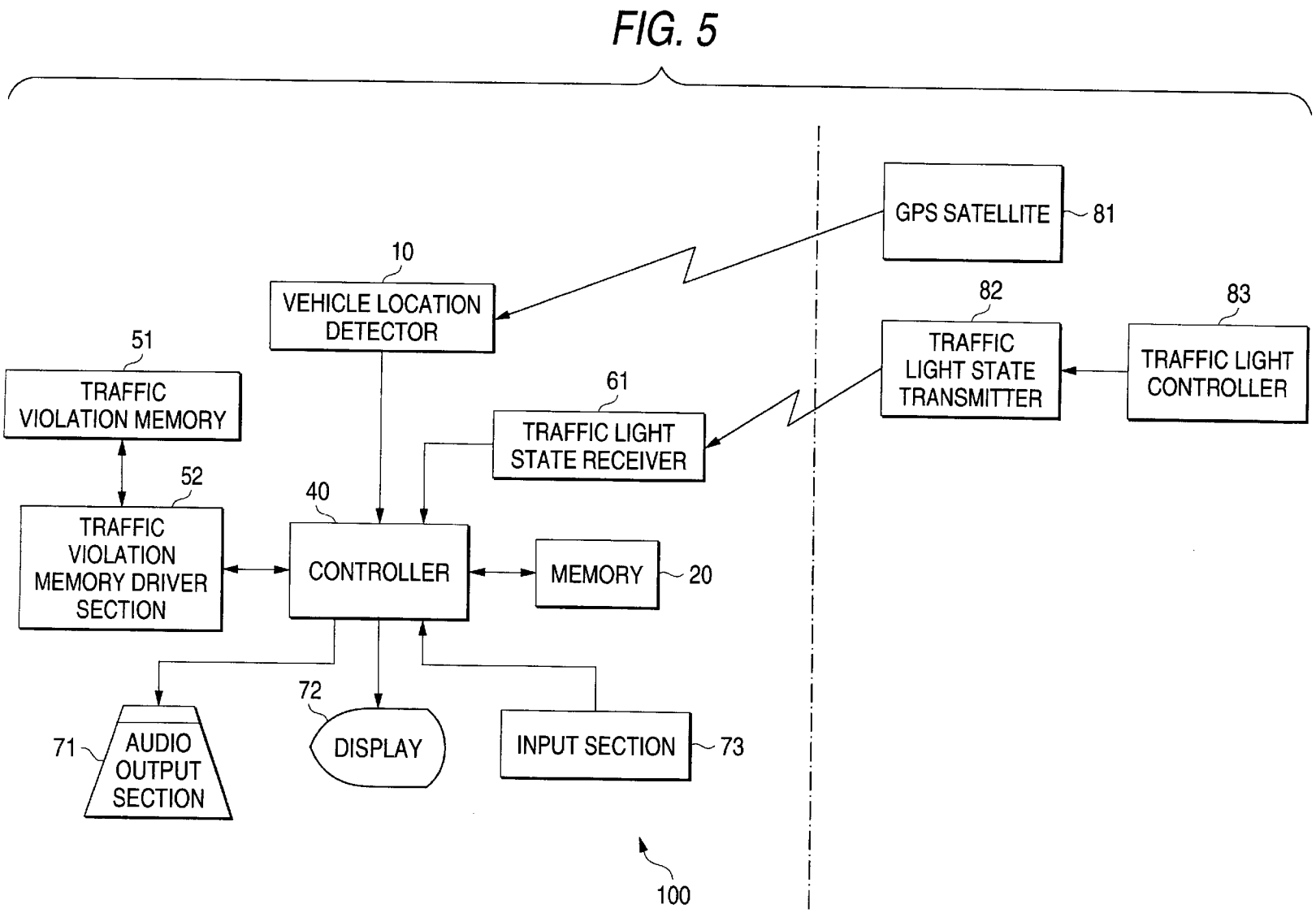
FIG. 5 is a functional block diagram of traffic violation warning and traffic violation storage apparatus according to the third embodiment of the invention.

FIG. 5 is a functional block diagram of traffic violation warning and traffic violation storage apparatus according to the third embodiment of the invention. The traffic violation warning and traffic violation storage apparatus 100 is composed of a vehicle location detector 10, memory 20, a controller 40, traffic violation memory 51, a traffic violation memory driver section 52, a traffic light state receiver 61, an audio output section 71, a display 72, and an input section 73. Basic configuration of the third embodiment is the same as the first embodiment except that a traffic light state receiver 61 is provided.

Figure 6:
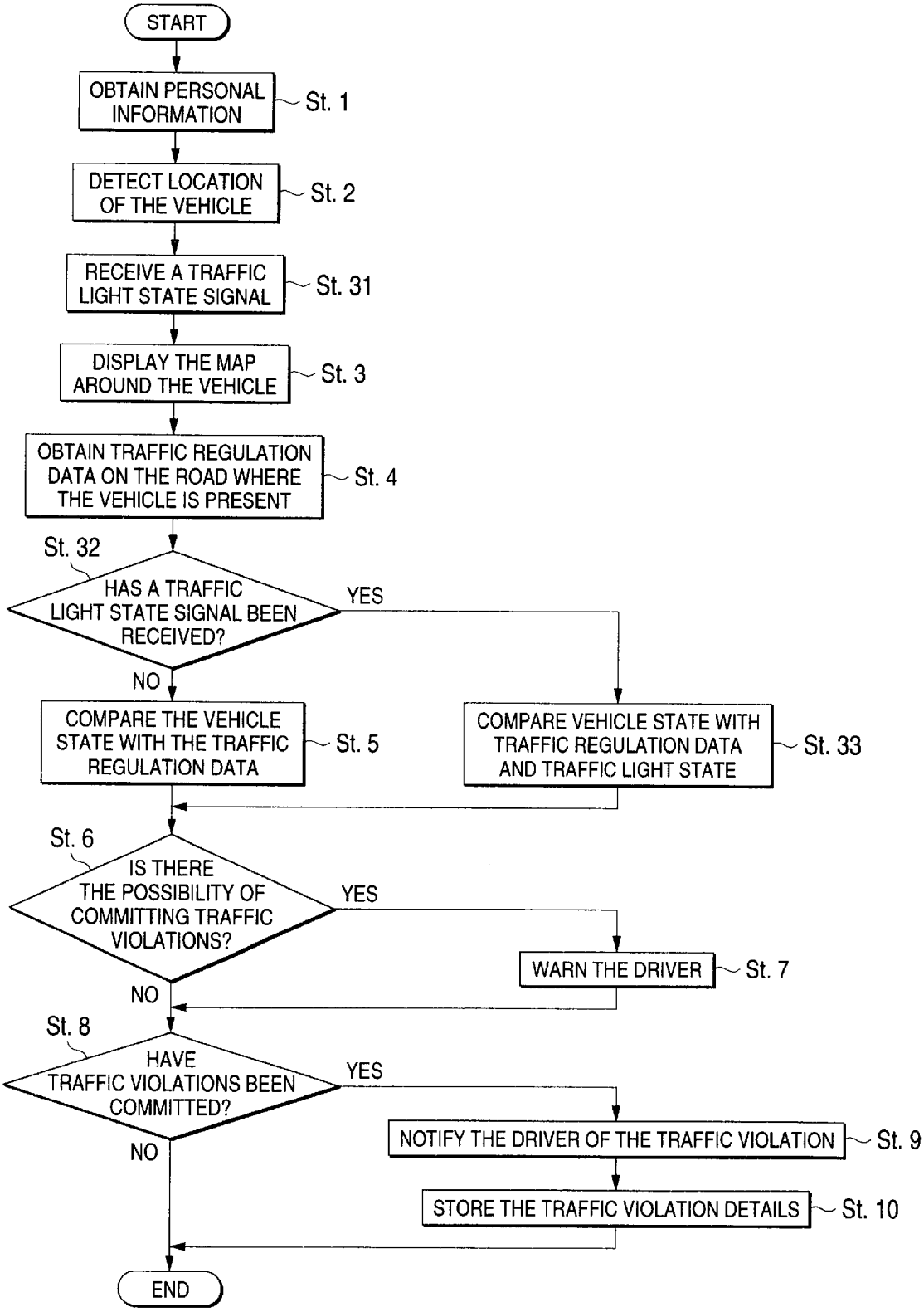
FIG. 6 is a flowchart showing the operation of the traffic violation warning and traffic violation storage apparatus according to the third embodiment of the invention.

In FIG. 5, the traffic light state receiver 61 receives traffic light state information. A traffic light controller 83 is means for controlling traffic lights. A traffic light state transmitter 82 obtains traffic light state information from the traffic light controller 83 and transmits the traffic light state information. FIG. 6 is a flowchart showing the operation of the traffic violation warning and traffic violation storage apparatus according to the third embodiment of the invention.

Operation of the traffic violation warning and traffic violation storage apparatus according to the third embodiment of the invention configured as mentioned earlier will be described referring to FIG. 5 and FIG. 6. Steps 1 and 2 in FIG. 6 are the same as those in the first embodiment.

In Step 31, the traffic light state receiver 61 receives traffic light state information and obtains the traffic light state on the road where the vehicle is traveling. The traffic light state information is information obtained and sent by the traffic light state transmitter 82 from the traffic light controller 83 for controlling traffic lights on the road where the vehicle is traveling. Steps 3 and 4 are same as those in the first embodiment.

In case traffic light state information is received in Step 32, execution proceeds to Step 33. Otherwise execution proceeds to Step 5.

In Step 33, the vehicle state information (time, speed and direction of travel) on the vehicle obtained from the vehicle location detector 10 is compared with the obtained traffic regulation data (speed limit, halt and do not enter) and the traffic light state information via the controller 40.

Steps 5 through 10 are the same as those in the first embodiment. For example, in case a vehicle is traveling at a speed of 40 km/h while the traffic light ahead is red, it is determined that there is the possibility that the driver commits ignorance of the traffic lights and a warning is issued. In case the vehicle ignored a red light and passed through a crossing, it is determined that traffic violation concerning ignorance of the traffic lights has been committed and the traffic violation is reported to the driver and recorded.

Thus, according to the third embodiment, traffic violation warning and traffic violation storage apparatus is used to receive a traffic light state signal and to determine traffic violations, thereby also addressing traffic violations concerning ignorance of the traffic lights.

(Embodiment 4)

A fourth embodiment of the invention is traffic violation warning and traffic violation storage apparatus for receiving modified traffic regulation data on the road where a vehicle is traveling and its vicinity, and updating the stored traffic regulation data.

Figure 7:
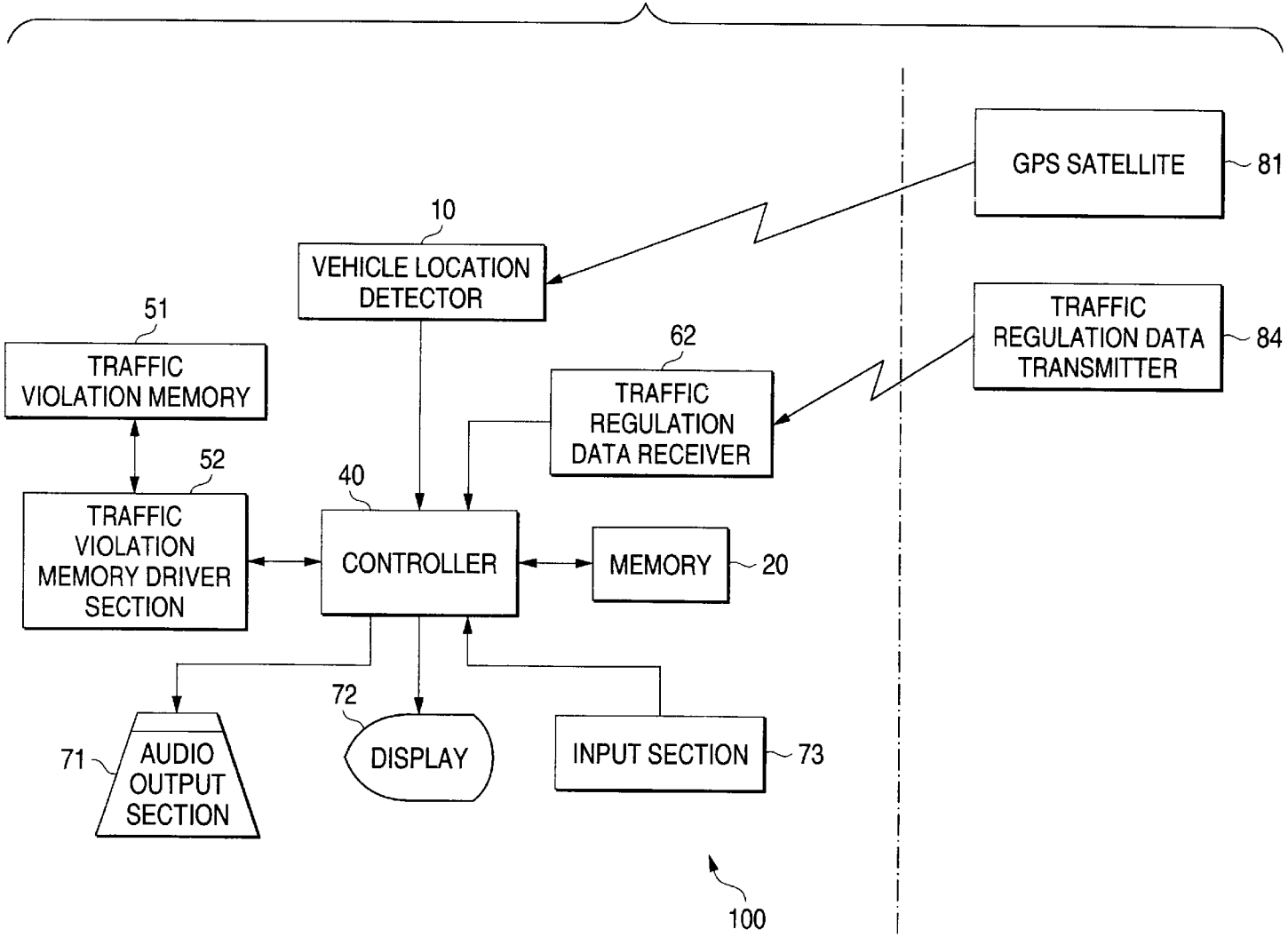
FIG. 7 is a functional block diagram of traffic violation warning and traffic violation storage apparatus according to the fourth embodiment of the invention.

FIG. 7 is a functional block diagram of traffic violation warning and traffic violation storage apparatus according to the fourth embodiment of the invention. The traffic violation warning and traffic violation storage apparatus 100 is composed of a vehicle location detector 10, memory 20, a controller 40, traffic violation memory 51, a traffic violation memory driver section 52, a traffic regulation data receiver 62, an audio output section 71, a display 72, and an input section 73. Basic configuration of the fourth embodiment is the same as the first embodiment except that a traffic regulation data receiver 62 is provided.

Figure 8:
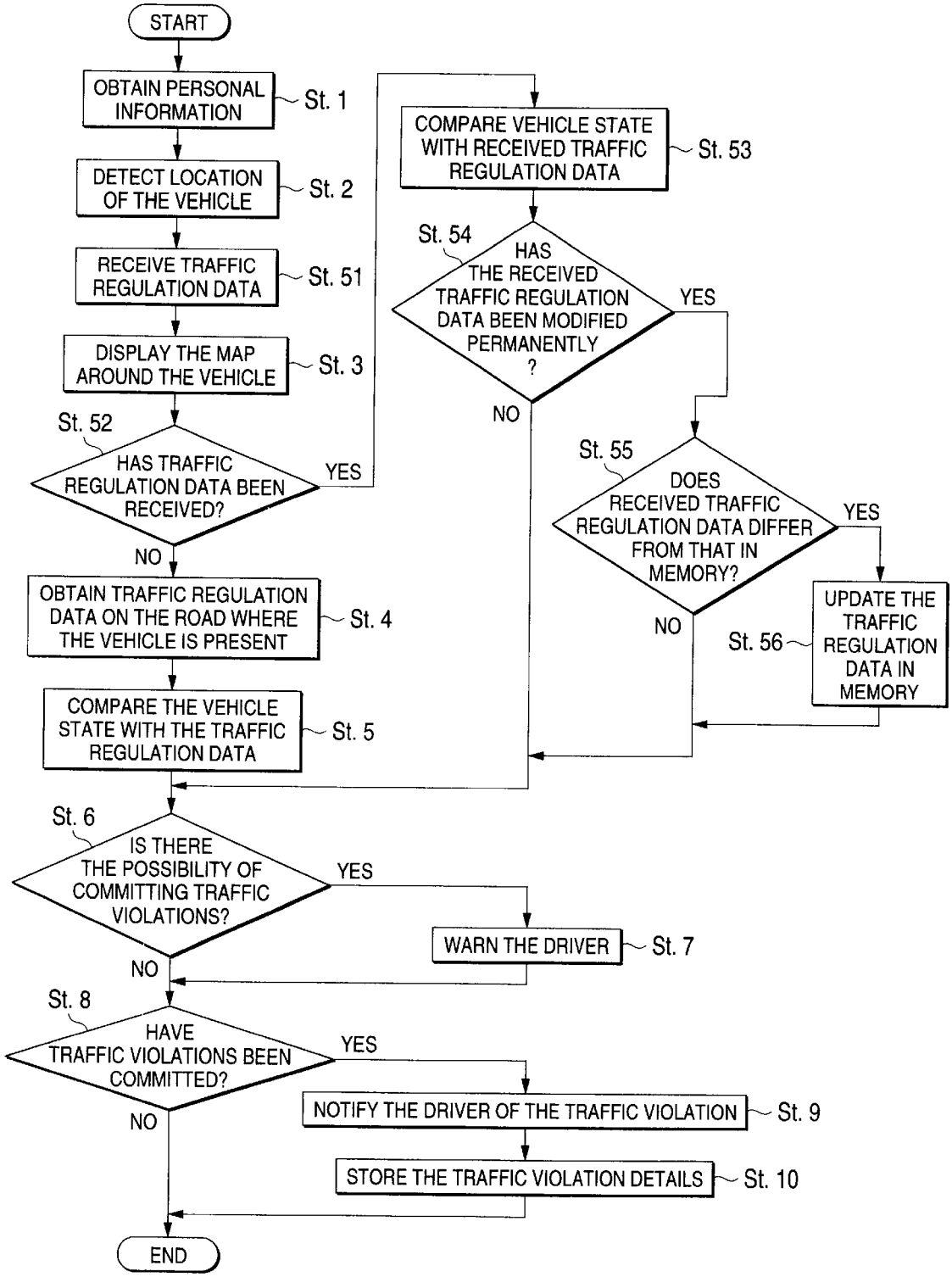
FIG. 8 is a flowchart showing the operation of the traffic violation warning and traffic violation storage apparatus according to the fourth embodiment of the invention.

In FIG. 7, the traffic regulation data receiver 62 receives traffic regulation data. A traffic regulation data transmitter 84 transmits temporarily or permanently modified traffic regulation data on the road where the vehicle is traveling and its vicinity. FIG. 8 is a flowchart showing the operation of the traffic violation warning and traffic violation storage apparatus according to the fourth embodiment of the invention.

Operation of the traffic violation warning and traffic violation storage apparatus according to the fourth embodiment of the invention configured as mentioned earlier will be described referring to FIG. 7 and FIG. 8. Steps 1 and 2 in FIG. 8 are the same as those in the first embodiment.

In Step 51, the temporarily or permanently modified traffic regulation data on the road where the vehicle is traveling and its vicinity is received and obtained by the traffic regulation data receiver 62. The traffic regulation data is transmitted from the traffic regulation data transmitter 84. Step 3 is the same as that in the first embodiment.

In Step 52, it is determined whether traffic regulation data has been received. In case traffic regulation data has been received, execution proceeds to Step 53. Otherwise, execution proceeds to Step 4.

In Step 53, the vehicle state information (time, speed and direction of travel) on the vehicle is compared with the received traffic regulation data (speed limit, halt and do not enter) via the controller 40.

In Step 54, it is determined whether the received traffic regulation data is permanently modified traffic regulation data. In case the received traffic regulation data is permanently modified traffic regulation data, execution proceeds to Step 55. In case the received traffic regulation data is temporarily modified traffic regulation data, execution proceeds to Step 6.

In Step 55, it is determined whether the received traffic regulation data is different from the traffic regulation data stored in the memory 20. In case the received traffic regulation data is different from the traffic regulation data stored in the memory 20, execution proceeds to Step 56. In case the received traffic regulation data is the same as the traffic regulation data stored in the memory 20, execution proceeds to Step 6.

In Step 56, the traffic regulation data in the memory 20 is overwritten with the permanently modified traffic regulation data and is thus updated. Steps 4 through 10 are the same as those in the first embodiment.

Thus, according to the fourth embodiment of the invention, traffic violation warning and traffic violation storage apparatus receives modified traffic regulation data on the road where a vehicle is traveling and its vicinity, and updates the stored traffic regulation data. Thus it is possible to determine traffic violations based on the latest traffic regulation data.

(Embodiment 5)

A fifth embodiment of the invention is traffic violation warning and traffic violation storage apparatus for receiving modified penal regulation data and updating the stored penal regulation data.

Figure 9:
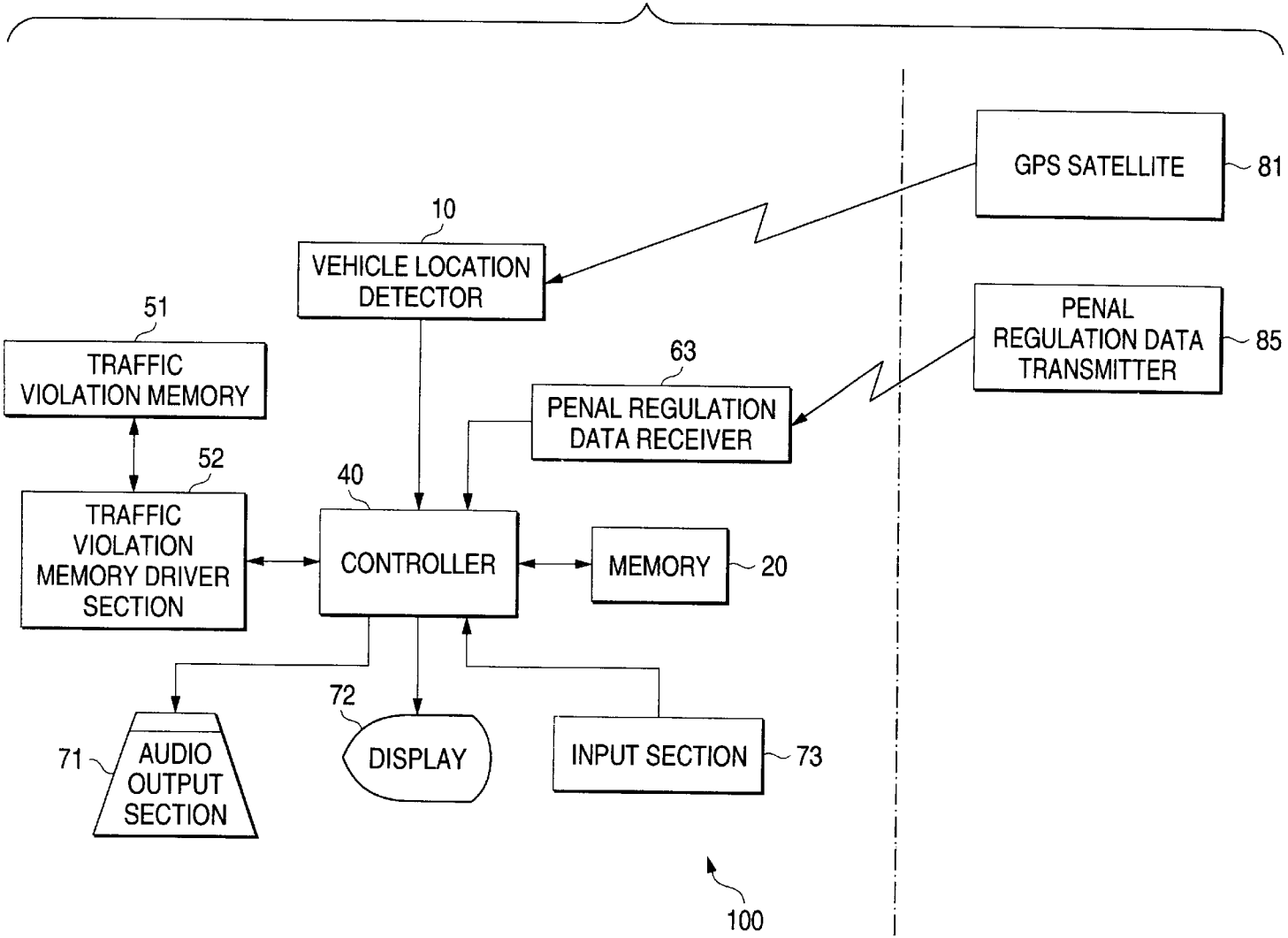
FIG. 9 is a functional block diagram of traffic violation warning and traffic violation storage apparatus according to the fifth embodiment of the invention.

FIG. 9 is a functional block diagram of traffic violation warning and traffic violation storage apparatus according to the fifth embodiment of the invention. The traffic violation warning and traffic violation storage apparatus 100 is composed of a vehicle location detector 10, memory 20, a controller 40, traffic violation memory 51, a traffic violation memory driver section 52, a penal regulation data receiver 63, an audio output section 71, a display 72, and an input section 73. Basic configuration of the fifth embodiment is the same as the first embodiment except that a penal regulation data receiver 63 is provided.

Figure 10:
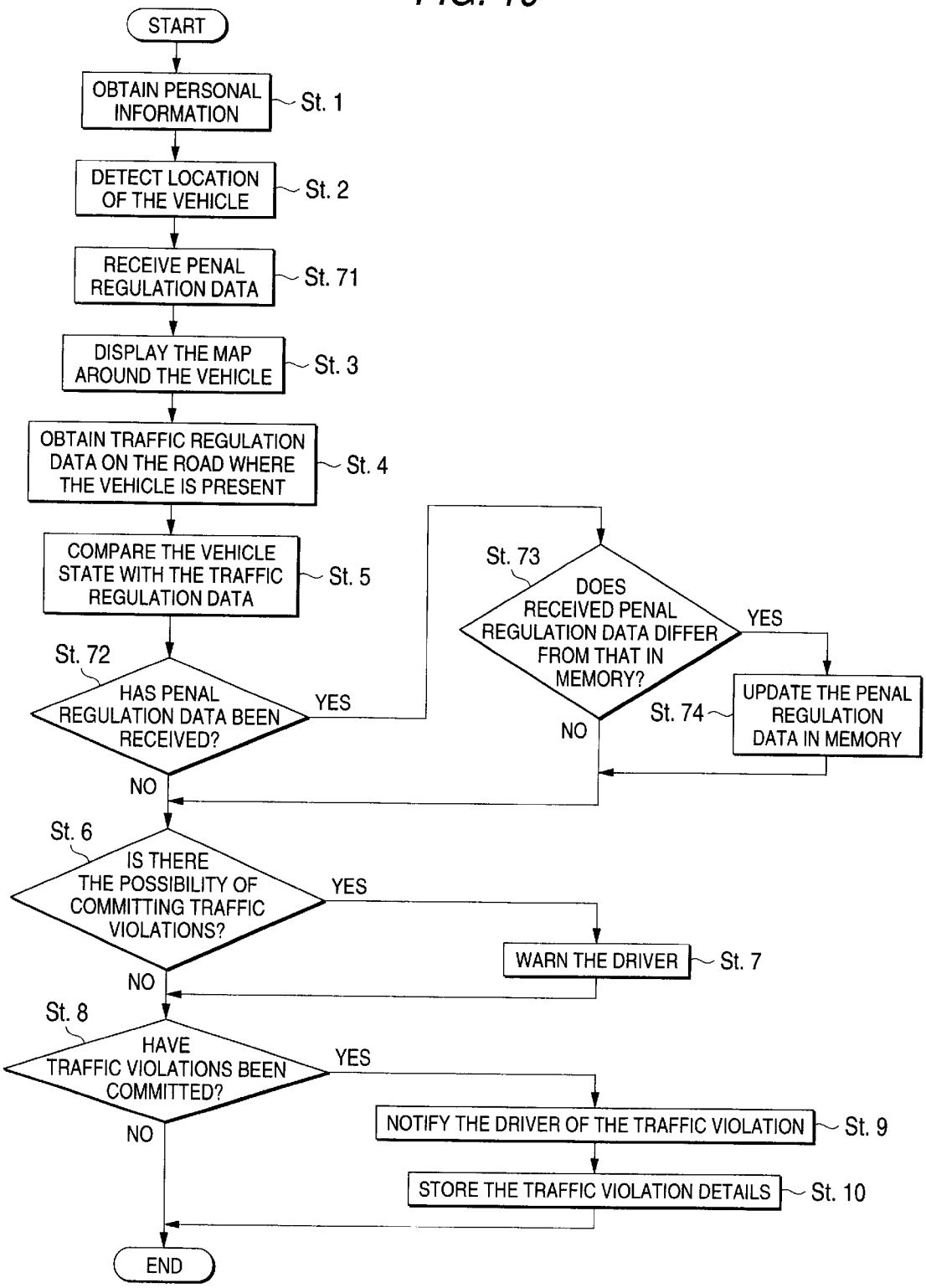
FIG. 10 is a flowchart showing the operation of the traffic violation warning and traffic violation storage apparatus according to the fifth embodiment of the invention.

In FIG. 9, the penal regulation data receiver 63 receives penal regulation data. A penal regulation data transmitter 85 transmits modified penal regulation data. FIG. 10 is a flowchart showing the operation of the traffic violation warning and traffic violation storage apparatus according to the fifth embodiment of the invention.

Operation of the traffic violation warning and traffic violation storage apparatus according to the fifth embodiment of the invention configured as mentioned earlier will be described referring to FIG. 9 and FIG. 10. Steps 1 and 2 in FIG. 10 are the same as those in the first embodiment.

In Step 71, the modified penal regulation data transmitted from the penal regulation data transmitter 85 is received by the penal regulation data receiver 63. Steps 3 through 5 are the same as those in the first embodiment.

In Step 72, it is determined whether penal regulation data has been received. In case penal regulation data has been received, execution proceeds to Step 73. Otherwise, execution proceeds to Step 6.

In case the received penal regulation data is different from the penal regulation data stored in the memory 20 in Step 73, execution proceeds to Step 74. In case the received penal regulation data is the same the penal regulation data stored in the memory 20, execution proceeds to Step 6.

In Step 74, the penal regulation data in the memory 20 is overwritten with the received penal regulation data and is thus updated. Steps 6 through 10 are the same as those in the first embodiment.

Thus, according to the fifth embodiment of the invention, traffic violation warning and traffic violation storage apparatus receives modified penal regulation data and updating the stored penal regulation data. Thus it is possible to notify a driver of the latest penal regulations in case the driver has committed traffic violations.

(Embodiment 6)

A sixth embodiment of the invention is traffic violation management apparatus for reading traffic violation details and personal information stored in traffic violation storage apparatus and storing such information in a database.

Figure 11:
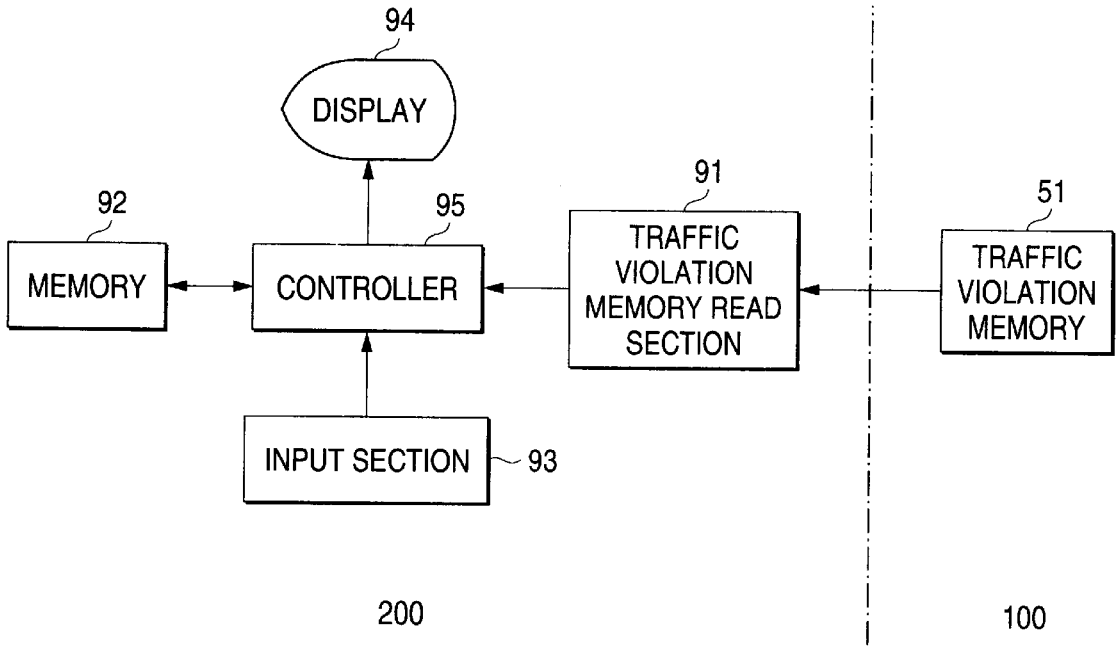
FIG. 11 is a functional block diagram of traffic violation management apparatus according to the sixth embodiment of the invention.

FIG. 11 is a functional block diagram of traffic violation management apparatus according to the sixth embodiment of the invention. The traffic violation management apparatus 200 is composed of a traffic violation memory read section 91, memory 92, an input section 93, a display 94 and a controller 95.

Figure 12:
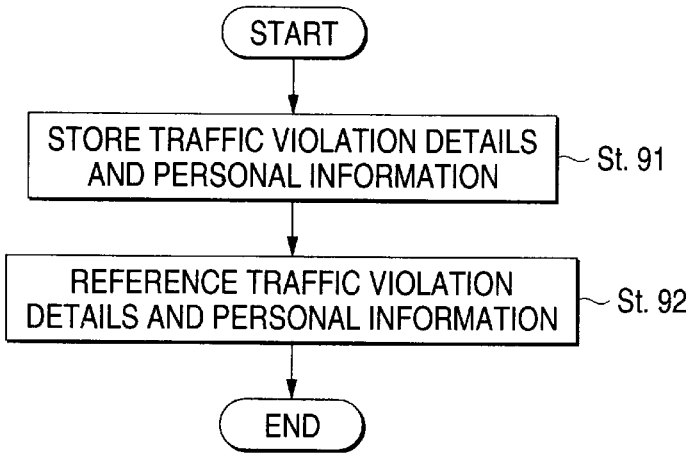
FIG. 12 is a flowchart showing the operation of the traffic violation management apparatus according to the sixth embodiment of the invention.
Figure 13:
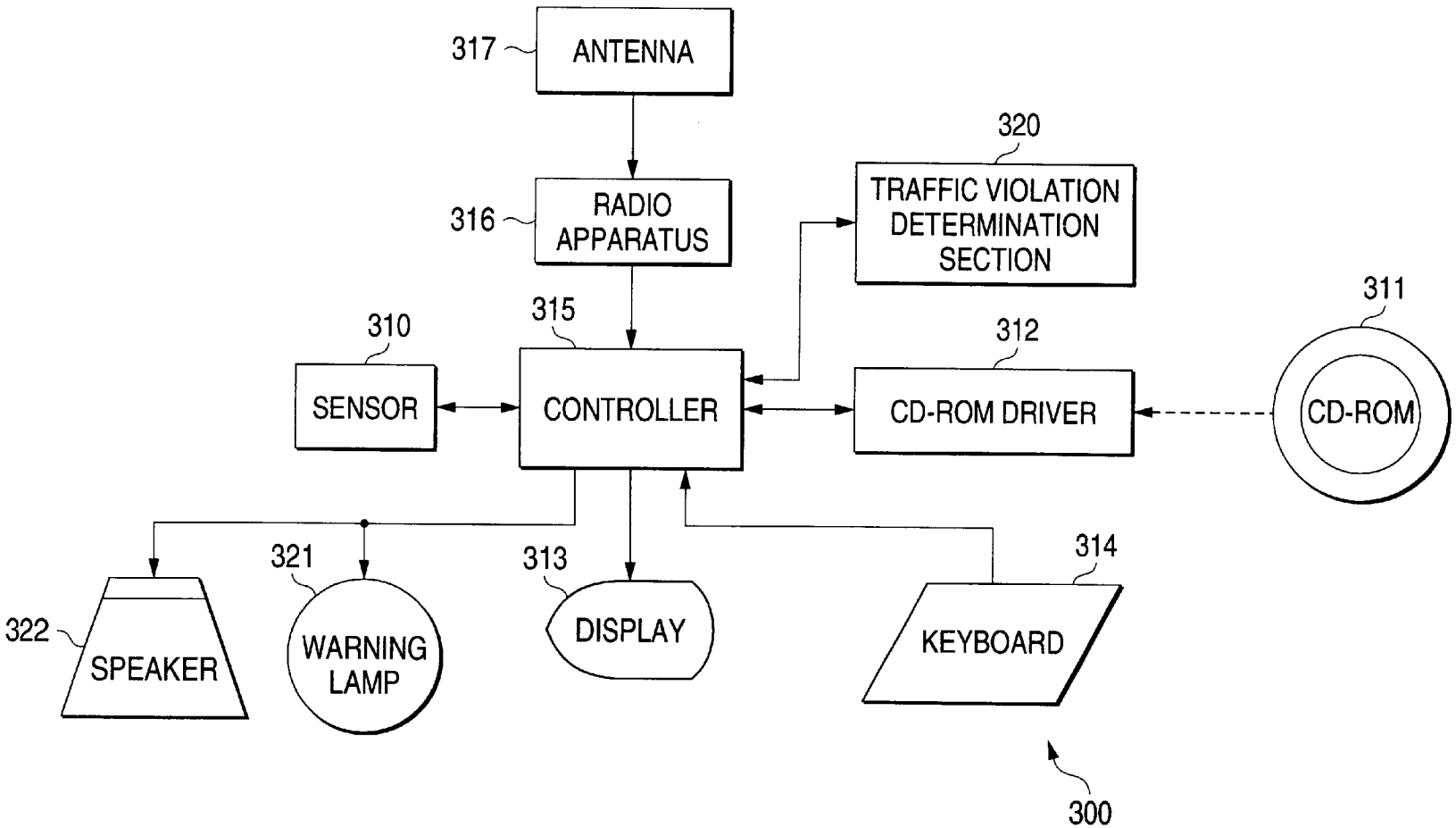
FIG. 13 shows the configuration of a related art vehicle-mounted car navigation system.

In FIG. 11, the traffic violation memory read section 91 reads traffic violation details and personal information stored in the traffic violation memory 51 of the traffic violation warning and traffic violation storage apparatus 100. The memory 92 stores the traffic violation details and personal information read from the traffic violation memory 51. The input section 93 accepts various settings and operations. The display 94 displays the traffic violation details and personal information. The controller 95 controls the functional sections. FIG. 12 is a flowchart showing the operation of the traffic violation management apparatus according to the sixth embodiment of the invention.

Operation of the traffic violation management apparatus according to the sixth embodiment of the invention configured as mentioned earlier will be described referring to FIG. 11 and FIG. 12.

In Step 91 in FIG. 12, traffic violation details and personal information are read by the traffic violation memory read section 91 and the traffic violation details and personal information are stored in the memory 92.

In Step 92, when a data reference command is accepted at the input section 93, the traffic violation details and personal information are read from the memory 92 and displayed on the display 94. The traffic violation details and personal information to be displayed may be retrieved using a variety of conditions (traffic violation details, personal information and date of recording in the traffic violation management apparatus)

Thus, according to the sixth embodiment of the invention, traffic violation management apparatus reads stored traffic violation details and personal information and storing such information in a database. As a result, it is possible to easily manage information related to traffic violations and select traffic violation details and personal information using a variety of conditions and easily browse desired data.

As understood from the foregoing description, according to the invention, traffic violation warning and traffic violation storage apparatus comprises a vehicle location detector for detecting the location and vehicle state of a vehicle to output vehicle state information, memory for storing at least either the map data, traffic regulation data or penal regulation data, traffic violation memory for storing personal information in advance, means for determining whether there is the possibility that a driver commits traffic violations based on the vehicle state information and traffic regulation data, means for issuing a traffic violation warning in case there is the possibility of committing traffic violations, means for determining whether a driver has committed traffic violations based on the vehicle state information and traffic regulation data, and means for storing traffic violation details in the traffic violation memory in case the driver has committed traffic violations. Via this configuration, driving that observes traffic regulations is possible before the driver commits traffic violations. In case the driver has committed traffic violations, the corresponding traffic violation details are stored in the traffic violation memory, therefore, smaller group of stuffs can assure control by checking the data in the traffic violation memory, when updating the driver's license for example.

The traffic violation warning and traffic violation storage apparatus comprises an encryption/decryption section for encrypting traffic violation details to be stored in traffic violation memory in case a driver has committed traffic violations. This provides an advantage that falsification of traffic violation details is prevented.

The traffic violation warning and traffic violation storage apparatus comprises a traffic light state receiver for receiving traffic light state information. This provides an advantage that traffic violations concerning ignorance of the traffic lights can be determined.

The traffic violation warning and traffic violation storage apparatus comprises a traffic regulation data receiver for receiving temporarily or permanently modified traffic regulation data. This provides an advantage that traffic violation can be determined to keep up with temporary modifications to traffic regulations due to weather or permanent modifications to traffic regulations, thereby allowing a driver to drive observing the modified traffic regulations and updating traffic regulation data.

The traffic violation warning and traffic violation storage apparatus comprises a penal regulation data receiver for receiving modified penal regulation data. This provides an advantage that penal regulation data can be updated.

The traffic violation management apparatus according to the invention comprises traffic violation memory read section for reading traffic violation details and personal information stored in the traffic violation memory of the traffic violation warning and traffic violation storage apparatus, memory for storing the traffic violation details and personal information, an input section for accepting various settings and operations, a display for displaying the traffic violation details and personal information, and a controller for controlling the functional sections. Thus provides an advantage that it is possible to store traffic violation details in a database and easily manage information related to traffic violations and retrieve and browse desired data by using a variety of conditions.

What is claimed is:

1. A traffic violation warning and traffic violation storage apparatus comprising:

a vehicle location detector which detects the location and vehicle state of a vehicle to output vehicle state information;

a memory which stores at least one of map data, traffic regulation data and penal regulation data;

a traffic violation memory which stores personal information in advance;

a first determination unit which determines whether there is a possibility that a driver commits traffic violations based on the vehicle state information and the traffic regulation data;

a warning unit which issues a traffic violation warning in case there is the possibility that the driver commits traffic violations;

a second determination unit which determines whether the driver has committed traffic violations based on the vehicle state information and the traffic regulation data; and a violation recording unit which records a traffic violation details in the traffic violation memory in case the driver has committed traffic violations.

2. A traffic violation warning and traffic violation storage apparatus according to claim 1, further comprising an encryption/decryption unit which encrypts the traffic violation details to be stored in the traffic violation memory in case the driver has committed traffic violations.

3. A traffic violation warning and traffic violation storage apparatus according to claim 1, further comprising a traffic light state receiver for receiving traffic light state information.

4. A traffic violation warning and traffic violation storage system comprising:

a traffic light state transmitter for transmitting traffic light state information obtained from a traffic light controller for controlling traffic lights;

a traffic light state receiver for receiving traffic light state information;

a vehicle location detector which detects the location and vehicle state of a vehicle to output vehicle state information;

a memory which stores at least one of map data, traffic regulation data and penal regulation data;

a traffic violation memory which stores personal information in advance;

a first determination unit which determines whether there is a possibility that a driver commits traffic violations based on the vehicle state information and the traffic regulation data;

a warning unit which issues a traffic violation warning in case there is the possibility that the driver commits traffic violations;

a second determination unit which determines whether the driver has committed traffic violations based on the vehicle state information and the traffic regulation data; and a violation recording unit which records a traffic violation details in the traffic violation memory in case the driver has committed traffic violations.

5. A traffic violation warning and traffic violation storage apparatus according to claim 1, further comprising a traffic regulation data receiver which receives temporarily or permanently modified traffic regulation data.

6. A traffic violation warning and traffic violation storage system comprising:

a traffic regulation data transmitter for transmitting traffic regulation data on the road where the vehicle is traveling and its vicinity; and a traffic regulation data receiver which receives temporarily or permanently modified traffic regulation data;

a vehicle location detector which detects the location and vehicle state of a vehicle to output vehicle state information;

a memory which stores at least one of map data, traffic regulation data and penal regulation data;

a traffic violation memory which stores personal information in advance;

a first determination unit which determines whether there is a possibility that a driver commits traffic violations based on the vehicle state information and the traffic regulation data;

a warning unit which issues a traffic violation warning in case there is the possibility that the driver commits traffic violations;

a second determination unit which determines whether the driver has committed traffic violations based on the vehicle state information and the traffic regulation data; and a violation recording unit which records a traffic violation details in the traffic violation memory in case the driver has committed traffic violations.

7. A traffic violation warning and traffic violation storage apparatus according to claim 1, further comprising a penal regulation data receiver for receiving modified penal regulation data.

8. A traffic violation warning and traffic violation storage system comprising:

a penal regulation data transmitter for transmitting penal regulation data on the road where the vehicle is traveling and its vicinity;

a penal regulation data receiver for receiving modified penal regulation data;

a vehicle location detector which detects the location and vehicle state of a vehicle to output vehicle state information;

a memory which stores at least one of map data, traffic regulation data and penal regulation data;

a traffic violation memory which stores personal information in advance;

a first determination unit which determines whether there is a possibility that a driver commits traffic violations based on the vehicle state information and the traffic regulation data;

a warning unit which issues a traffic violation warning in case there is the possibility that the driver commits traffic violations;

a second determination unit which determines whether the driver has committed traffic violations based on the vehicle state information and the traffic regulation data; and a violation recording unit which records a traffic violation details in the traffic violation memory in case the driver has committed traffic violations.

9. A traffic violation management apparatus comprising:

a traffic violation memory reading unit which reads traffic violation details and personal information stored in the traffic violation memory of the traffic violation warning and traffic violation storage apparatus comprising:

a vehicle location detector which detects the location and vehicle state of a vehicle to output vehicle state information;

a memory which stores at least one of map data, traffic regulation data and penal regulation data;

a traffic violation memory which stores personal information in advance;

a first determination unit which determines whether there is a possibility that a driver commits traffic violations based on the vehicle state information and the traffic regulation data;

a warning unit which issues a traffic violation warning in case there is the possibility that the driver commits traffic violations;

a second determination unit which determines whether the driver has committed traffic violations based on the vehicle state information and the traffic regulation data;

a violation recording unit which records a traffic violation details in the traffic violation memory in case the driver has committed traffic violations;

a management memory which stores the traffic violation details and the personal information;

a management display which displays the traffic violation details and the personal information;

an input unit which accepts various operations; and a management controller which controls the functional sections.

* * * * *